US009157316B2

(12) United States Patent
Wessling et al.

(10) Patent No.: US 9,157,316 B2
(45) Date of Patent: Oct. 13, 2015

(54) SYSTEM AND METHOD FOR DETERMINING PRESSURE TRANSITION ZONES

(75) Inventors: Stefan Wessling, Hannover (DE); XiaoWei Wang, Houston, TX (US); Anne Bartetzko, Celle (DE); Jianyong Pei, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 820 days.

(21) Appl. No.: 13/360,376

(22) Filed: Jan. 27, 2012

(65) Prior Publication Data

US 2012/0199397 A1 Aug. 9, 2012

Related U.S. Application Data

(60) Provisional application No. 61/437,984, filed on Jan. 31, 2011.

(51) Int. Cl.

| | |
|---|---|
| ***E21B 47/06*** | (2012.01) |
| *E21B 21/08* | (2006.01) |
| *E21B 49/00* | (2006.01) |

(52) U.S. Cl.

CPC ..... *E21B 47/06* (2013.01); *E21B 21/08* (2013.01); *E21B 49/00* (2013.01)

(58) Field of Classification Search

CPC ..... E21B 47/06; E21B 49/00; E21B 21/08
USPC ..... 175/50; 73/152.02, 152.03, 152.05, 73/152.16, 152.22, 152.51; 702/6, 7, 9, 11
See application file for complete search history.

(56) References Cited

U.S. PATENT DOCUMENTS

| | | | | |
|---|---|---|---|---|
| 3,382,933 | A * | 5/1968 | Hottman | 175/50 |
| 3,399,723 | A * | 9/1968 | Stuart | 166/254.2 |
| 3,785,446 | A * | 1/1974 | Fertl et al. | 175/50 |
| 5,128,866 | A * | 7/1992 | Weakley | 702/11 |
| 5,130,949 | A * | 7/1992 | Kan et al. | 367/27 |
| 5,233,568 | A * | 8/1993 | Kan et al. | 367/27 |
| 2007/0246263 | A1 | 10/2007 | Reitsma | |
| 2009/0165548 | A1 | 7/2009 | Pop et al. | |
| 2010/0000729 | A1 | 1/2010 | Alberty | |

OTHER PUBLICATIONS

International Search Report and Written Opinion dated Sep. 24, 2012 for International Application No. PCT/US2012/023076; all references in PCT are cited above.

Bartetzko, A. et al.; "Challenges for Wellbore Stability Workflow Automation," DGMK/OGEW—Fruhjahrstagung 2011, Fachbereich Aufsuchung and Gewinnung , Celle, Apr. 11/12, 2011, pp. 1-10.

(Continued)

*Primary Examiner* — Nicole Coy
(74) *Attorney, Agent, or Firm* — Cantor Colburn LLP

(57) ABSTRACT

A method and apparatus for estimating a pressure transition zone in a borehole is disclosed. A parameter indicative of formation fluid pressure at a plurality of borehole depths is measured. A global trend of the parameter is determined over a first depth interval and a local trend of the parameter is determined over a second depth interval. A relation is determined between the global trend and the local trend, and the pressure transition zone is determined from the determined relation between the determined global trend and the determined local trend.

19 Claims, 8 Drawing Sheets

(56) References Cited

OTHER PUBLICATIONS

Wessling, Stefan et al.; "Automation in Wellbore Stability Workflows," SPE 149766, SPE Intelligent Energy International, Utrecht, The Netherlands, Mar. 27-29, 2012, pp. 1-12.

Wessling, Stefan et al.; "Automated Wellbore Stability Systems—Experience with Pore Pressure Modeling," IPTC 14935, International Petroleum Technology Conference, Bangkok, Thailand, Feb. 7-9, 2012, pp. 1-10.

* cited by examiner

SYSTEM AND METHOD FOR DETERMINING PRESSURE TRANSITION ZONES

CROSS-REFERENCE TO RELATED APPLICATIONS

This application claims priority to U.S. Provisional Application Ser. No. 61/437,984 filed on Jan. 31, 2011.

BACKGROUND OF THE DISCLOSURE

1. Field of the Disclosure

The present disclosure is related to identifying fluid pressure zones in a formation during drilling of a borehole.

2. Description of the Related Art

When drilling a borehole, it is important to monitor formation fluid pressure to avoid problems that can occur due to pressure imbalances downhole. Such problems can include kicks and blowouts, to name a few. In addition, monitoring formation fluid pressure enables a drilling operator to obtain various pressure-dependent parameters, i.e. the fracture gradient and the shear failure gradient, that describe the stability of a borehole. These stability parameters are typically influenced by changes in formation fluid pressure which may occur, for example, due to drilling or by natural geological variations. Real-time knowledge about the formation fluid pressure in various regions of the drilled formation is therefore useful for safe drilling. The present disclosure enables a drilling operator to identify transition depths, pressure zones or regions and characteristics of the identified pressure zones by providing analysis of fluid pressure data and generation of various parameters and alerts related to fluid pressure downhole.

SUMMARY OF THE DISCLOSURE

In one aspect of the present disclosure, a method of determining a pressure transition depth in a borehole is provided, including: obtaining measurements of a parameter indicative of formation fluid pressure at a plurality of borehole depths; determining a global trend of the parameter from the obtained measurement over a first depth interval; determining a local trend of parameter from the obtained measurements over a second depth interval; determining a relation between the estimated global trend and the estimated local trend; and determining the pressure transition depth from the determined relation between the determined global trend and the determined local trend.

In another aspect of the present disclosure, an apparatus for estimating a pressure transition depth in a borehole is provided, the apparatus including: a sensor configured to measure a parameter indicative of formation fluid pressure at a plurality of borehole depths; and a processor configured to: determine a global trend of the parameter from the obtained measurements over a first depth interval, determine a local trend of the parameter from the obtained measurements over a second depth interval, determine a relation between the global trend of the parameter and the local trend of the parameter, and determine the pressure transition depth from the determined relation between the global trend of the parameter and the local trend of the parameter.

In yet another aspect of the present disclosure, a method of drilling a borehole is provided, the method including: conveying a drilling assembly having a sensor configured to obtaining measurements of a parameter indicative of formation fluid pressure; obtaining measurements of the parameter at a plurality of borehole depths during drilling of the wellbore; determining a global trend of the parameter from the obtained measurement over a first depth interval; determining a local trend of parameter from the obtained measurements over a second depth interval; determining a relation between the estimated global trend and the estimated local trend; determining the pressure transition depth from the determined relation between the determined global trend and the determined local trend; and determining a pore pressure over a selected borehole depth and generating an alert if the determined pore pressure is non-hydrostatic.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
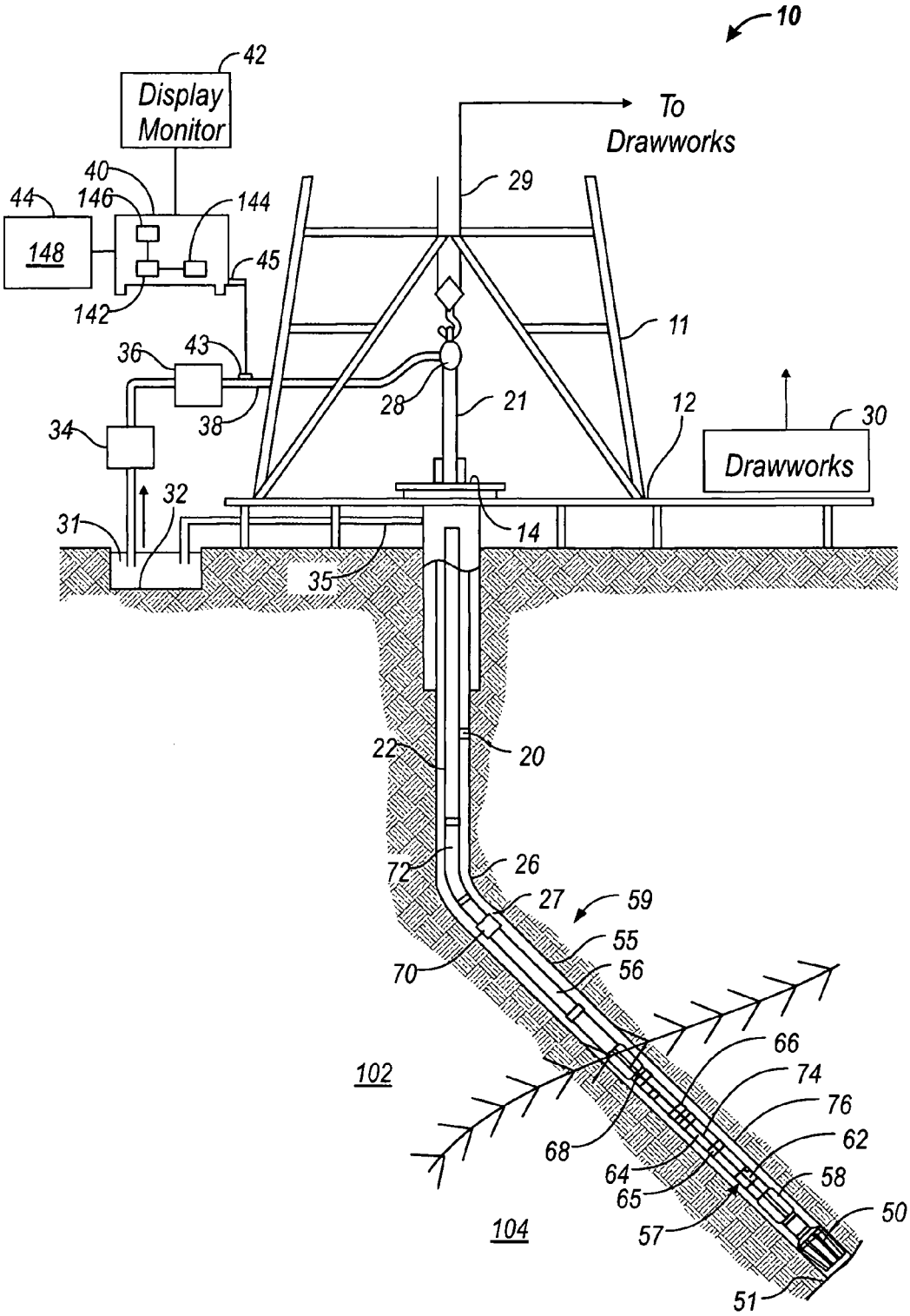
FIG. 1 shows a schematic diagram of a drilling system having a downhole assembly containing a sensor system and the surface devices suitable for performing the methods disclosed herein according to one embodiment of present disclosure.

FIG. 1 shows a schematic diagram of a drilling system 10 having a downhole assembly containing a sensor system and the surface devices suitable for performing the methods disclosed herein according to one embodiment of present disclosure. As shown, the system 10 includes a conventional derrick 11 erected on a derrick floor 12 which supports a rotary table 14 that is rotated by a prime mover (not shown) at a desired rotational speed. A drill string 20 that includes a drill pipe section 22 extends downward from the rotary table 14 into a borehole 26. A drill bit 50 attached to the drill string downhole end disintegrates the geological formations when it is rotated. The drill string 20 is coupled to a drawworks 30 via a kelly joint 21, swivel 28 and line 29 through a system of pulleys 27. During the drilling operations, the drawworks 30 is operated to control the weight on bit and the rate of penetration of the drill string 20 into the borehole 26. The operation of the drawworks is well known in the art and is thus not described in detail herein.

During drilling operations a suitable drilling fluid (commonly referred to in the art as "mud") 31 from a mud pit 32 is circulated under pressure through the drill string 20 by a mud pump 34. The drilling fluid 31 passes from the mud pump 34 into the drill string 20 via a desurger 36, fluid line 38 and the kelly joint 21. The drilling fluid is discharged at the borehole bottom 51 through an opening in the drill bit 50. The drilling fluid circulates uphole through the annular space 27 between the drill string 20 and the borehole 26 and is discharged into the mud pit 32 via a return line 35. Preferably, a variety of sensors (not shown) are appropriately deployed on the surface according to known methods in the art to provide information about various drilling-related parameters, such as fluid flow rate, weight on bit, hook load, etc.

A drill motor or mud motor 55 coupled to the drill bit 50 via a drive shaft (not shown) disposed in a bearing assembly 57 rotates the drill bit 50 when the drilling fluid 31 is passed through the mud motor 55 under pressure. The bearing assembly 57 supports the radial and axial forces of the drill bit, the downthrust of the drill motor and the reactive upward loading from the applied weight on bit. A stabilizer 58 coupled to the bearing assembly 57 acts as a centralizer for the lowermost portion of the mud motor assembly.

In the exemplary embodiment of the system 10, a downhole subassembly 59 (also referred to as the bottomhole assembly or "BHA") is coupled between the drill bit 50 and the drill pipe 22. The BHA typically contains various sensors and MWD devices to provide information about downhole drilling parameters and the mud motor. In addition, the BHA includes various sensors (formation evaluation sensors) for measuring various formation parameters or providing information useful for evaluating and testing subsurface formations along borehole 26. In one embodiment, the formation evaluation sensors provide a parameter related to a fluid pressure of the formation. Such formation evaluation sensors may include a resistivity measurement device 64 for measuring the formation electrical resistivity or conductivity (which is the inverse of resistivity) near and/or in front of the drill bit, an acoustic measurement device 65 for measuring acoustic properties of the formation such as a slowness (inverse of the velocity) of compressional or shear waves traveling through the drilled formation, a density measurement device 66 for measuring density, and a nuclear magnetic resonance (NMR) device 68, among others. In addition, detectors for seismic and/or vertical seismic profiling can be used. In general, detectors suitable for obtaining parameters indicative of a variation in formation porosity with depth or in formation fluid pressure can be used. Such parameters may in one aspect include drilling parameters such as a drilling exponent. In one embodiment, the BHA can traverse the borehole 26 and provide measurements to create a log of a borehole using one or more of the parameters obtained from the formation evaluation sensors. The downhole assembly 59 preferably can be modular in construction in that the various devices are interconnected sections so that the individual sections may be replaced when desired.

Inclinometer 74 is suitably placed along the resistivity measuring device 64 for respectively determining the inclination of the portion of the drill string near the drill bit 50. Any suitable inclinometer may be utilized for the purposes of this invention. In addition, an azimuth device (not shown), such as a magnetometer or a gyroscopic device, may be utilized to determine the drill string azimuth. Such devices are known in the art and are, thus, not described in detail herein. In the above-described configuration, the mud motor 55 transfers power to the drill bit 50 via one or more hollow shafts that run through the various formation evaluation sensors. The hollow shaft enables the drilling fluid to pass from the mud motor 55 to the drill bit 50. In an alternate embodiment of the drill string 20, the mud motor 55 may be coupled below formation evaluation sensors or at any other suitable place.

A surface control unit 40 receives signals from the downhole sensors and devices via a sensor 43 placed in the fluid line 38 and processes such signals according to programmed instructions provided to the surface control unit. The surface control unit displays desired drilling parameters and other information on a display/monitor 42 which information is utilized by an operator to control the drilling operations. The controller 40 (also referred herein as the surface controller or the surface control unit) may be a computer-based unit and may include a processor 142, a suitable data storage device 144, including, but not limited to, a solid state memory, hard disk, and magnetic tape, storing data and computer programs 146 for use by the processor 142. Any suitable display device 42, such as a monitor, may be provided to display images and other data during logging of the borehole 26. During operations, the controller 40 transmits operating instructions or commands to the BHA 59, receives data from the BHA, and processes the data in accordance with the instruction in the programs 146. The controller 40 may store the processed data, prepare and process the data, display the results, including images of the borehole and/or send such information to a remote unit for further processing. The control unit 140 is typically adapted to activate alarms 44 when certain unsafe or undesirable operating conditions occur or when a parameter of interest to an operator meets a selected criterion.

In addition to processor 142 of surface control unit 40, a downhole processor 70 may be used to perform various functions for evaluation and analysis of data, such as formation evaluation sensor data. In one embodiment, downhole processor 70 may be used to perform the exemplary methods disclosed herein for determining formation fluid pressure. Alternatively, processor 142 may perform the exemplary methods. In yet another embodiment, the downhole processor and surface processor each perform a portion of the disclosed methods and transfer data back and forth. In one embodiment, data may be transmitted to the surface control unit 40 using a suitable telemetry system 72.

The above-noted devices transmit data to the downhole telemetry system 72, which in turn transmits the received data uphole to the surface control unit 40. The downhole telemetry also receives signals and data from the uphole control unit 40 and transmits such received signals and data to the appropriate downhole devices. The present invention preferably utilizes a mud pulse telemetry technique to communicate data from downhole sensors and devices during drilling operations. A transducer 43 placed in the mud supply line 38 detects the mud pulses responsive to the data transmitted by the downhole telemetry system 72. Transducer 43 generates electrical signals in response to the mud pressure variations and transmits such signals via a conductor 45 to the surface control unit 40. Other telemetry techniques such as wired-pipe telemetry, electromagnetic and acoustic techniques or any other suitable technique may be utilized for the purposes of this invention.

Still referring to FIG. 1, borehole 26 is shown traversing two formation regions or zones 102 and 104 which can have different formation fluid pressure characteristics. Generally, data obtained from a pressure zone can be used to determine the formation fluid pressure and a pressure zone characteristic to enable an operator to make adjustments to drilling parameters or drilling mud parameters that address changes in mud or fluid pressure downhole in the annulus of the wellbore.

In one aspect, formation evaluation data may be acquired during a drilling operation (while-drilling data) or after at least a section of the borehole has been drilled and the drilling equipment is being pulled out of the borehole or is being pushed into the hole for re-logging. Alternatively, data may be acquired while reaming the wellbore or when increasing the diameter of the hole after it has initially been drilled at a smaller diameter. Pulling or pushing the drilling equipment into or out of the hole is generally referred to as tripping.

While-drilling, while-reaming and/or re-logging data is acquired by at least one sensor which is installed in the bottom-hole assembly behind the drill bit. The data are then transmitted to a processor which may be downhole processor 70 or surface processor 142, for example, for data analysis and interpretation.

In an alternate embodiment, data may be obtained using a wireline logging device. Wireline logging uses sensors installed in an assembly that is connected to a wire and then run through the borehole after the bottom-hole assembly has been pulled out of the borehole. In addition to the system shown in FIG. 1, the methods disclosed herein are equally applicable to a drilling system from a sea platform.

Figure 2:
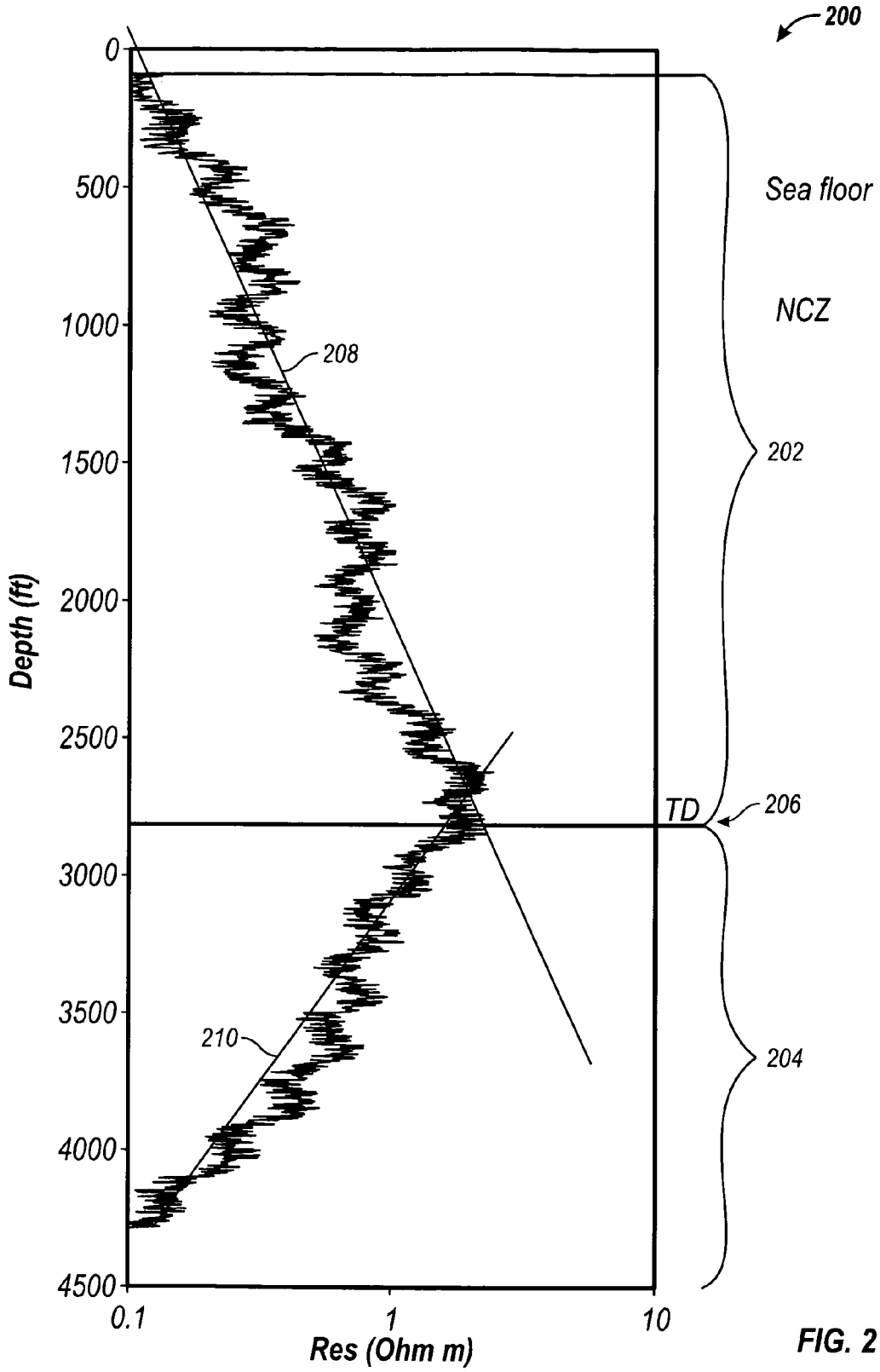
FIG. 2 shows an exemplary log of a parameter related to a formation fluid pressure which may be obtained using the exemplary system of FIG. 1.

FIG. 2 shows an exemplary log 200 of a parameter of the formation which is related to formation fluid pressure. The parameter may be obtained using the system of FIG. 1. The exemplary parameter shown in FIG. 2 is the resistivity of the formation surrounding the borehole being drilled. The parameter may be any parameter that is related to the pore pressure of the formation, including, but not limited to formation resistivity, formation porosity, formation acoustic slowness, formation density and a nuclear magnetic resonance parameter. The exemplary log 200 shows resistivity (horizontal axis) plotted against the borehole depth (vertical axis). The log 200 shows a first region from 0 feet depth (i.e., surface or sea floor) to a depth of approximately 2800 feet over which the resistivity increases with depth and a second region below about 2800 feet over which the resistivity decreases with depth. The depth 206 (about 2800ft) at which a trend line of the parameter (in this case, resistivity) changes is referred to as the transition depth (TD) 206. In the exemplary log 200 of FIG. 2, the region above the TD 206 is referred to herein as the normal compaction zone (NCZ) 204. Within the normal compaction zone, fluid contained in the pore or void space of the sedimentary material is squeezed out of the sediments with continuous burial. The sedimentary material which is deposited on the ground of sedimentary offshore basins is said to be normally compacted and a trend of decreasing porosity with depth is associated with the normal compaction. As a consequence, the fluid contained in the porous or void space of the sediments is hydrostatically distributed with depth. The region below the TD 206 is referred to herein as the under compaction zone (UCZ) 204. In the undercompaction zone the fluid in the porous or void space of the sedimentary material can not be squeezed out with continuous burial, either due to impermeable sediment deposited above the undercompacted zone or due to a fast sedimentation rate so that the fluid dissipation is slow compared to the sedimentation rate. As a consequence, the decrease of porosity with depth (continuous burial) remains less than expected under normal compaction conditions, and the formation fluid pressure in the pores is larger than hydrostatic pressure. A line 208 fitted over the measurements of the parameter shows the trend of the parameter in the NCZ 202. Trend line 208 is referred to as the normal compaction trend line (NCTL). The trend line 208 may be obtained using any curve fitting method, including, but not limited to, regression analysis, least-squares fitting and any other data-fitting method known in the art. Line 210 fitted over the measurements in the UCZ 204 shows the trend of the parameter in the UCZ 204.

Figures 3A, 3B:
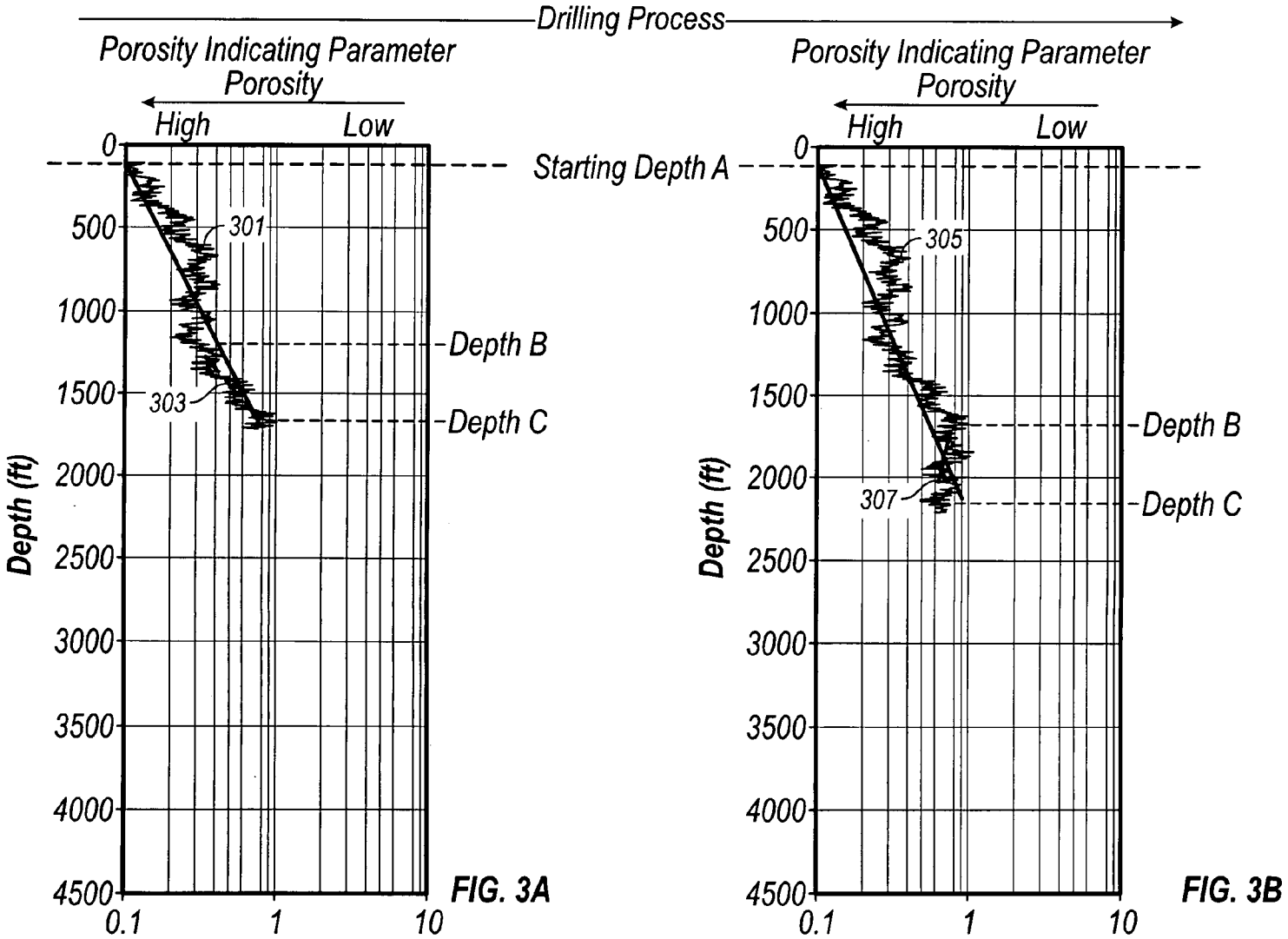
FIGS. 3A-D show logs obtained at various depths in a borehole during a drilling of the borehole.
Figure 3D:
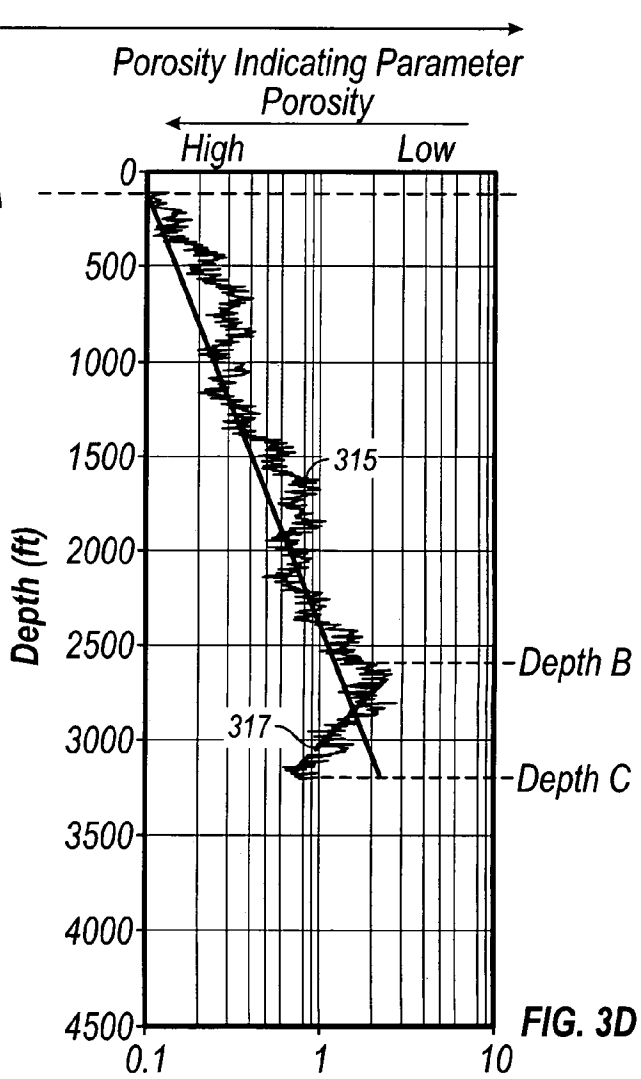
Figure 3C:
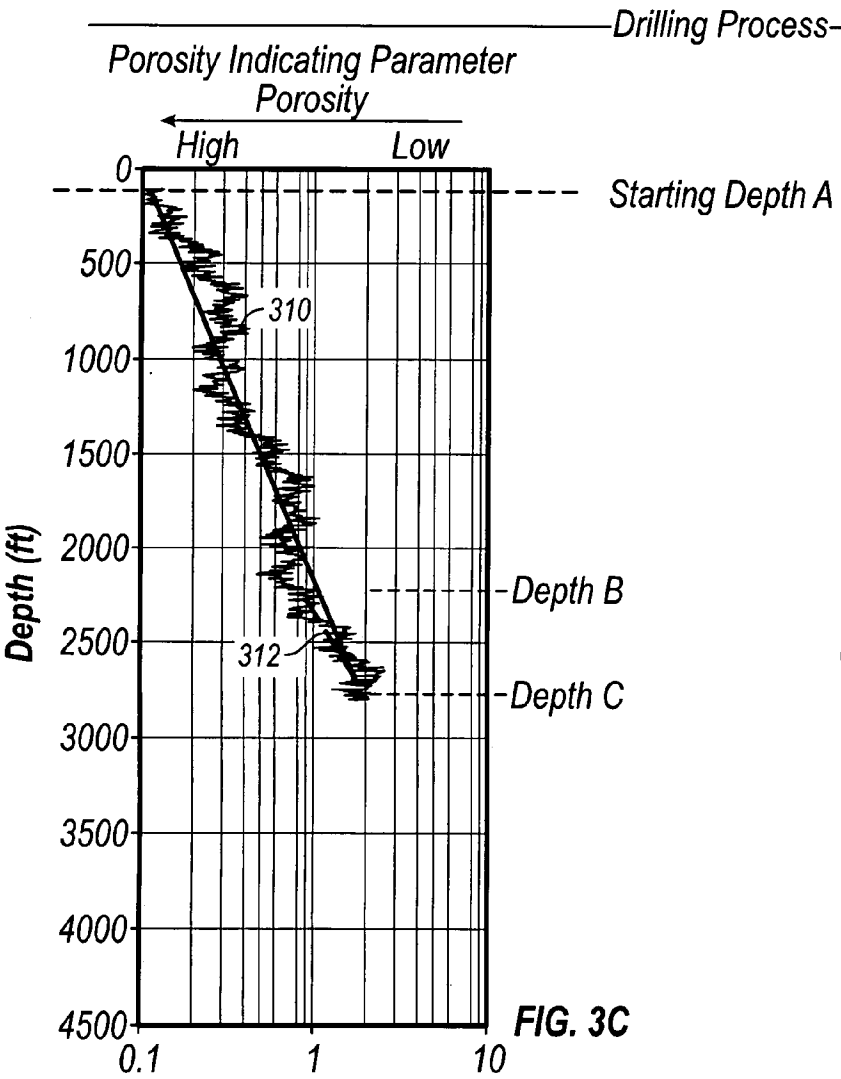

FIGS. 3A-D show exemplary logs of another parameter 310 of the formation (porosity), obtained at various depths in a borehole during a drilling of the borehole. In FIG. 3A, a global trend line 301 is drawn from the starting depth A to a depth C, indicating the general trend of the parameter over the selected interval. In FIG. 3A, depth C is at approximately 1700 ft. A local trend line 303 is shown for the exemplary parameter over an interval between depth B and depth C. The interval for obtaining a local trend line may be selected by a user or by a processor running a program. The depth interval for the local trend line may be a selected well depth or distance, a selected number of measurements (e.g., 100 most recent parameter values), or measurements obtained during a selected interval of time. In the particular example of FIG. 3A, local trend line 303 and global trend line 301 do not have the same slope, but the difference between the slopes is considered within an acceptable margin. FIG. 3B shows a global trend line 305 and a local trend line 307 obtained for a drilling interval extending to a depth of approximately 2200 ft. At this depth, the local trend line 307 is decreasing with depth, which may prompt an operator to review the data. The operator may check to determine if at this depth the formation is no longer hydrostatic. Also, the operator may check to determine whether the drilling apparatus (such as shown in FIG. 1) is entering a transition zone between pressure zones. FIG. 3C shows a global trend line 310 and a local trend line 312 obtained for a drilling interval extending to a depth of approximately 2700 ft. In FIG. 3C, the local trend line is in reasonable agreement with the global trend line. FIG. 3D shows a global trend line 315 and a local trend line 317 obtained for a drilling interval extending to a depth of approximately 3200 ft. The difference between the local trend line 317 and the global trend line 315 are in opposite directions and thus may meet a criterion to prompt an operator to review the log and determine whether the drilling apparatus has entered a transition zone or for a processor in the system 10 (FIG. 1) to determine whether the drilling has entered into a transition and/or alert the operator of such finding.

The exemplary parameter of FIGS. 2 and 3 is plotted on a log-linear scale, with depth being plotted on the linear scale. Other parameters may relate linearly to fluid pressure and may therefore be plotted on a linear scale. Still other parameters may relate to fluid pressure via an exponential term and thus may be scaled appropriately. The methods described herein may be performed using any of the parameters that relate to pressure of the formation.

Figure 4:
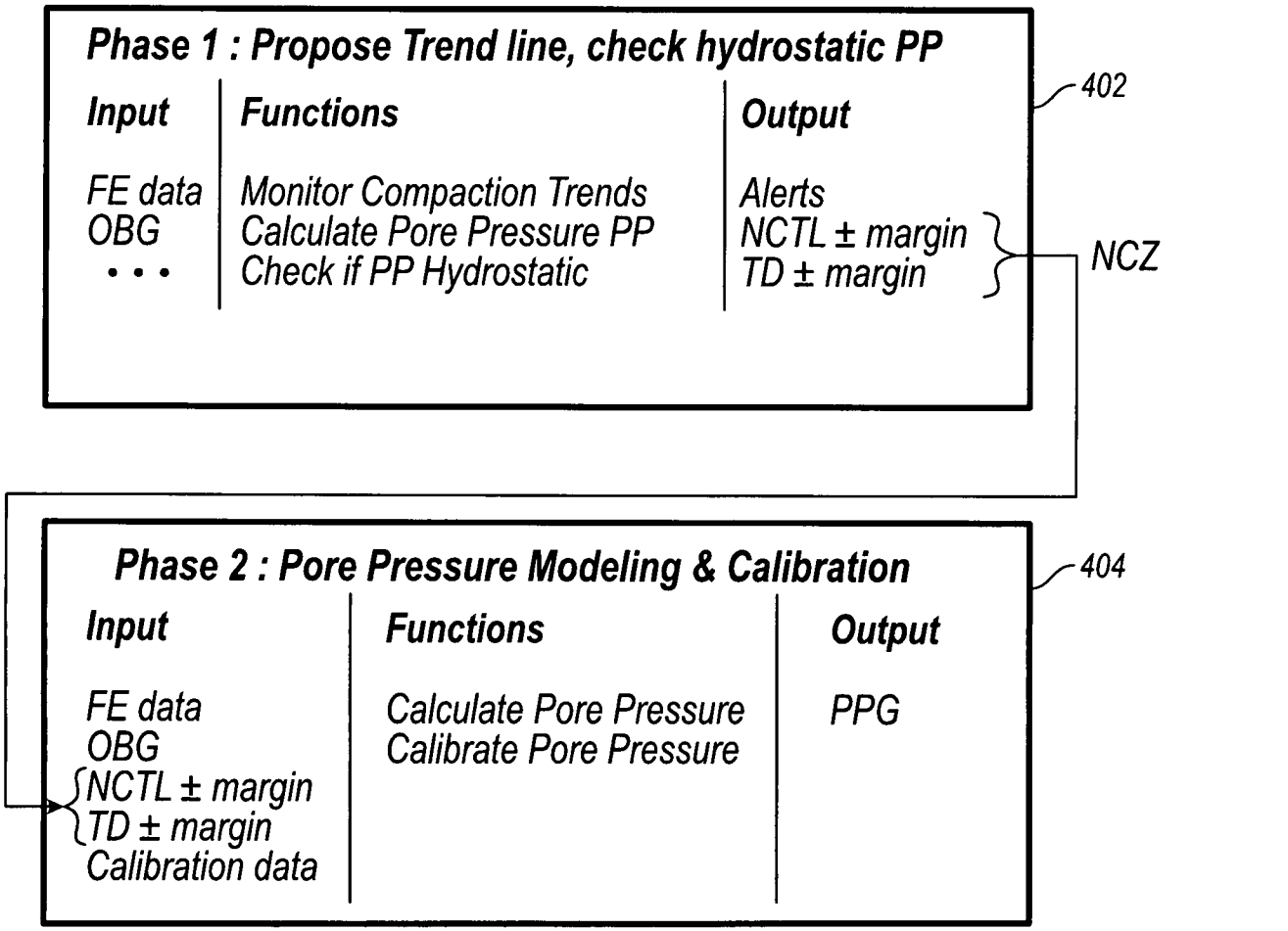
FIG. 4 shows typical phases for determining formation fluid pressure in one aspect of the present disclosure.

In one method 400, determining formation fluid pressure employs a first phase (Phase 1) 402 and a second phase (Phase 2) 404, as shown in FIG. 4. In Phase 1 (402), pressure zones are identified, transition depth or transition zone is determined and zone characteristics are determined. In the Phase 2 (404), pore pressure modeling and calibration are performed. Parameters determined in the Phase 1 (402) may be used in Phase 2 (404). Phase 1 (402) may receive inputs in the form of formation evaluation (FE) data/parameters, over-burden gradient (OBG) data, etc. obtained from the various formation evaluation sensors described in reference to FIG. 1. Phase 1 (402) monitors compaction trends, determines global and local trend lines, calculates pore pressure (PP) and determines if pore pressure is hydrostatic. In an embodiment in which monitoring occurs while drilling, the global trend line is determined as long as drilling is performed in the normal compaction zone. If the method detects a transition depth that is then confirmed by an operator, the method exits Phase 1 (402) and exports various parameters (e.g., intercept and slope) defining the global trend line to an apparatus such as a processor for performing the Phase 2 (404) procedure. In another aspect, the method may detect the transition depth, exit Phase 1 (402) and export the parameters without alerting the operator. Phase 2 (404) may perform modeling of the pore pressure and/or calibration of the pore pressure model whenever calibration data/information is available. The inputs to Phase 2 may include FE data, OBG, NCTL. TD, calibration data, etc. The functions performed in Phase 2 may include calculation of pore pressure and calibration of pore pressure. The outputs from Phase 2 include pore pressure gradient (PPG).

Figure 5:
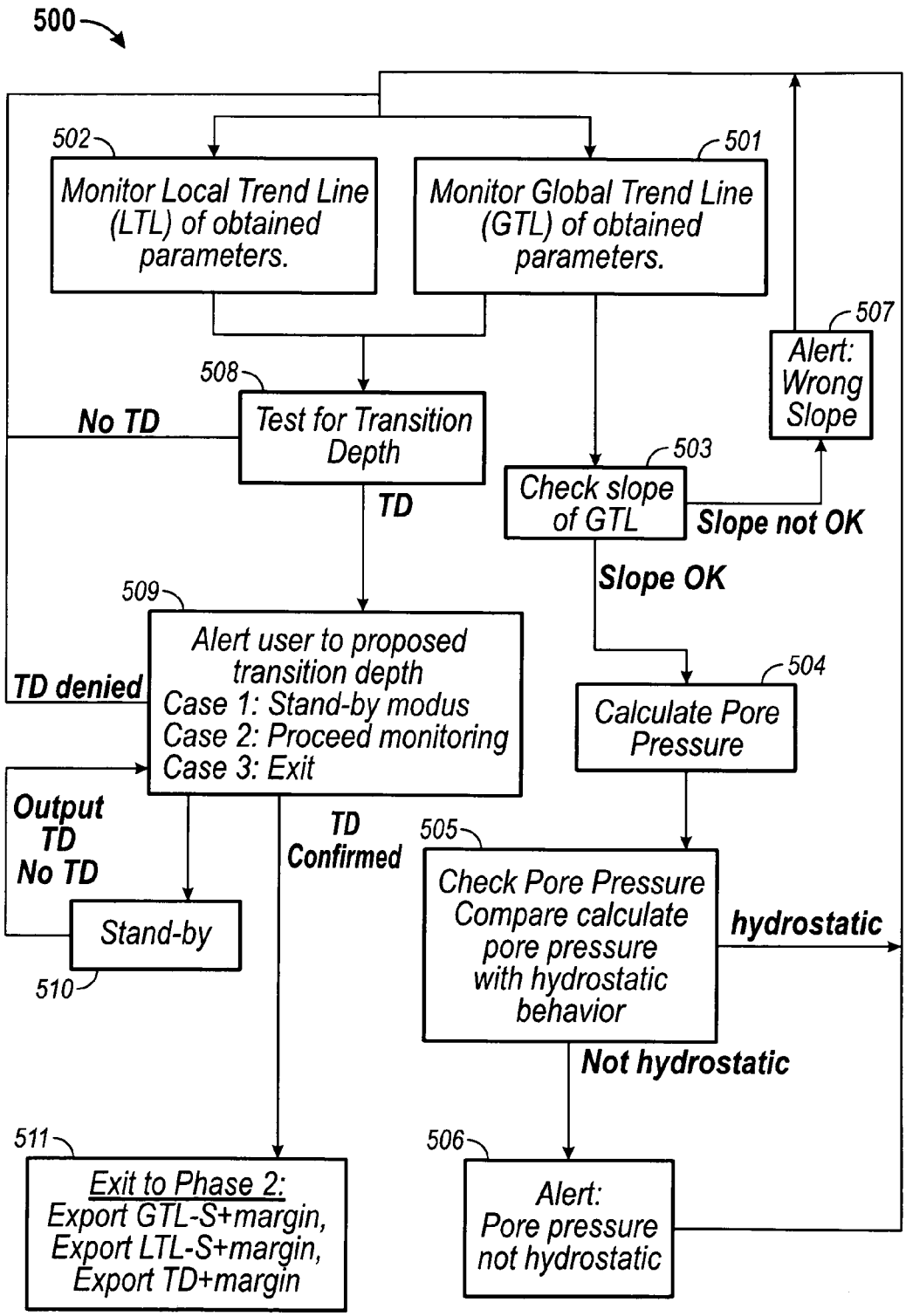
FIG. 5 shows a flowchart of an exemplary method of the first phase of FIG. 4.

FIG. 5 shows a method 500 in the form of a flowchart of certain details of Phase 1 (402) shown in FIG. 4 for identifying pressure regions and their pressure characteristics as well as a transition depth between pressure regions. The method 500 includes processes 501 and 502 for determining global and local trends of a parameter of interest, such as porosity, resistivity, etc. Process 501 monitors a global trend line for the parameters. In one embodiment, the global trend line (GLT) is obtained using regression analysis on the obtained parameter data. The global trend line is determined over a large depth interval, which may range from the first data point (shallowest, often at a surface location) up to the last (deepest) data point. The global trend line may be determined using all or some of the data obtained in the large depth interval. Process 501 outputs a slope (−S) and intercept (−I) of the global trend line. Process 502 monitors a local trend line (LTL) of the parameters. The LTL is the trend line determined for a subset of the parameters, such as the most recently obtained parameter measurements. The much smaller depth interval for the local trend lines may includes the latest (deepest) pre-defined amount of data, or all data within a pre-defined latest (deepest) depth interval. The depth interval defining the local trend line can be user defined, depending on the quality of the data, the geological environment, etc. Alternatively, a processor may automatically define the depth interval defining the local trend line. In an exemplary embodiment, the local trend line is determined from parameters obtained over the most recent depth interval (for example, the previous 100 feet). Process 502 obtains and outputs a slope (−S) and intercept (−I) of local trend line (LTL). Depth may be the true vertical depth, which is the vertical distance between a considered point along the borehole trajectory and the surface. However, the measured depth (length of the borehole trajectory) can also be used with the methods disclosed herein.

In one embodiment, an uncertainty is assigned to the trends at each depth interval. In particular, uncertainties may be assigned to the parameters contained in the mathematical expression of the trend lines. For example, if a linear regression is performed to obtain the trend line, an uncertainty may be assigned to the slope and the intercept of the trend line. The uncertainties can be used for subsequent processes such as for calibrating formation pore pressure over a range within which parameters are allowed to be changed for calibration. The monitoring processes 501 and 502 may further include data filtering, or the selection of those data that have been acquired in a particular formation, such as shale formation along the borehole. In one aspect, the method disclosed herein determines a change in the slope of a trend line from positive to negative or from negative to positive. The sequence of the signs of the trends (from negative to positive or from positive to negative) depends on the data that is analyzed. The disclosed method is furthermore able to store results of the comparison over different depth intervals. Once a pre-defined amount of changes in the trends has been detected, the system may be configured to generate an alert that informs the user about a potential deviation of the formation pore pressure from an expected value and may request confirmation from the user. The formation pore pressure may be calculated from the data using any suitable method. Also, appropriate modeling parameters (such as an Eaton exponent) may be predefined. Furthermore, the process is able to check whether the calculated formation pore pressure follows a hydrostatic trend, which is a normal formation pore pressure trend. If a deviation to the hydrostatic formation pore pressure from normal (hydrostatic) is recognized, an alert may be generated.

In one aspect, the global trend line and obtained formation evaluation data are used to determine a pressure characteristic of the formation. Process 503 receives a slope of the global trend line and determines whether or not the slope is correct. This is illustrated with respect to FIG. 6 discussed below. Staying with FIG. 5, if the process 503 determines that the global trend line is not acceptable, an alert is generated in process 507 and monitoring of the trend lines continues (processes 501 and 502). If the process 503 determines that the global trend line is acceptable, process 504 calculates a pore pressure from the global trend line. Process 504 may receive information about over-burden gradient, slope and/or intercept of the global trend line and appropriate formation evaluation data and may output a pore pressure using such inputs. Process 505 compares the calculated pore pressure against pore pressure for a hydrostatically pressured formation to determine whether the pore pressure is hydrostatic or non-hydrostatic. If the pore pressure is determined to be hydrostatic, drilling continues and the process is monitored according to processes 501 and 502. If the pore pressure is determined to be non-hydrostatic, an alert is generated (process 506) to an operator. Process 506 may alert the operator to a possible overpressure condition.

In another aspect, the method 500 determines a transition depth or transition zone. A pressure transition zone is referred to as a zone in which the formation pore pressure regime changes from hydrostatic (normal) such as in NCZ 202 of FIG. 2 to non-hydrostatic, which can be either higher than hydrostatic ("overpressure") or lower than hydrostatic ("underpressure") such as in UCZ 204 of FIG. 2. Process 508 proposes a candidate for a transition depth (TD) by comparing the global trend line with the local trend line. The comparison may yield a measure of the deviation or difference between them. If the comparison meets a selected criterion or a set of selected criteria, an alarm may be generated indicating a possible transition depth, in which case relevant data may be sent to an operator or program for review. In various embodiments, the process 508 may compare a slope of the global trend line with the slope of the local trend line. Alternatively, the process 508 may compare the intercepts of the global trend line and the local trend line. The process 508 may compare both slopes and intercepts of the global trend line and the local trend line. In yet another embodiment, a summation of local derivatives may be compared. If no transition depth is proposed, the method returns to monitoring processes 501 and 502. If a transition depth is proposed, the method proceeds to process 509.

Process 509 generates an alert to a system operator upon identification of a proposed transition zone and provides the parameter of interest and various data to a user or program. While the user is deciding whether the data indicates a transition depth, a standby mode 510 is entered. During standby mode, a user or program confirms or denies the proposed transition depth. In one embodiment, process 509 may wait (do nothing) until either prompted by the user or until the user returns a confirmation or denial of the proposed transition depth. Alternatively, the user may request additional data, in which case logging and/or drilling may be continued to measure parameters at additional depths of the wellbore. The user may set a reminder to verify a transition zone once the logging/drilling apparatus or wireline has traveled a selected distance, for example 50 ft., or after a selected amount of time, for example, every 15 minutes. Subsequently obtained parameters can be provided to enable the user to reach a decision. In the stand-by mode, the system displays the incoming data in order to visualize the upcoming trend lines for continuous drilling. If the user indicates that the proposed transition depth is not a transition depth, the method proceeds to continue monitoring (processes 501 and 502). If the user confirms the proposed transition depth, the method exits to Phase 2 via process 511 and the determination of the global trend line stops. Global trend line parameters (slope and intercept) may be provided for Phase 2.

In an alternative embodiment, process 509 offers a list of previously detected potential transition depths to the user so that the user may confirm a transition depth from the previously proposed transition depths. The parameters of the appropriate global transition trend line are then exported to Phase 2. The proposed method is thus able to determine a trend of the data over at least two pre-defined depth intervals.

Figure 6B:
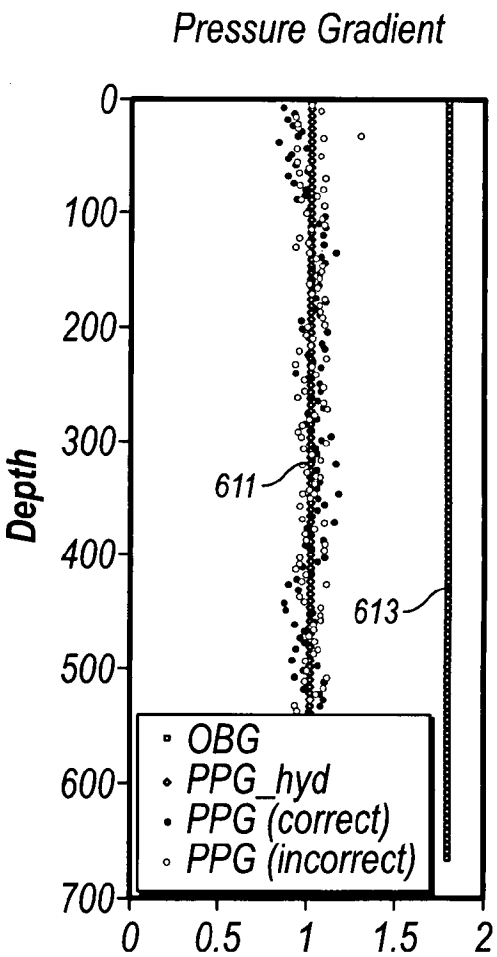
FIGS. 6A and 6B show an exemplary logging dataset and related pressure gradient.
Figure 6A:
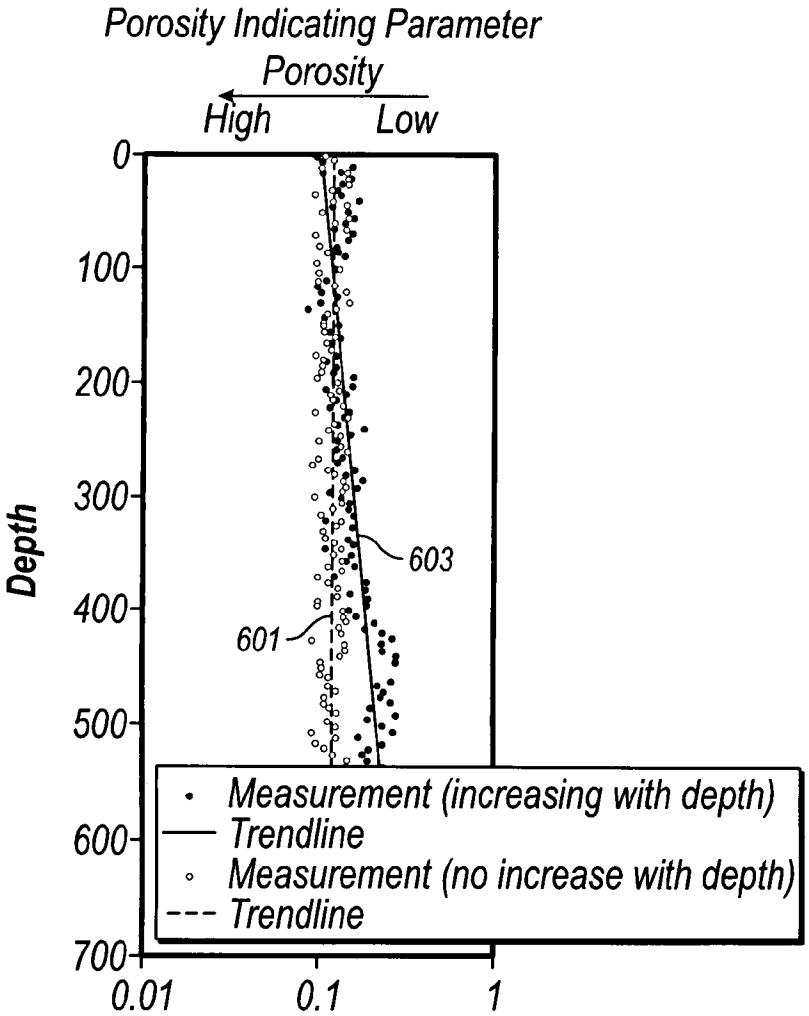

FIGS. 6A and 6B show exemplary logging dataset and related pressure gradients. FIG. 6A shows a porosity log. Two trend lines 601 and 603 are drawn on the log. Trend line 601 does not display an expected behavior for a formation log. Trend line 601 is constant but is expected to increase linearly with depth on a logarithmic scale. In addition, trend line 601 does not indicate a porosity that changes with depth. Therefore, a compaction based model for the formation may not be applicable. Trend line 603, however, has the expected non-zero slope, indicating a porosity that changes with depth. The global trend line is checked to determine correct behavior of the method. The global trend line is checked using the log of FIG. 6A. The pressure gradients 611 and 613 (FIG. 6B) associated with global trend lines 601 and 603 have similar behavior and are therefore not usable.

Figure 7:
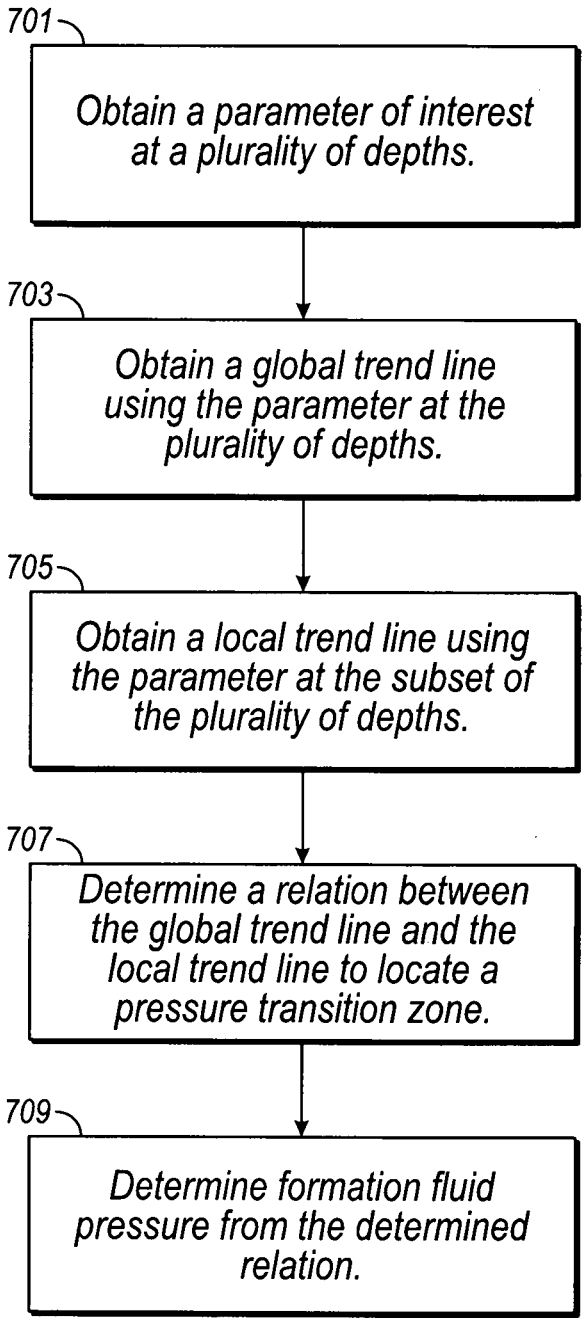
FIG. 7 shows an exemplary flowchart of one aspect of the present invention for determining a formation fluid pressure from a parameter of interest related to the fluid pressure.

FIG. 7 shows an exemplary flowchart of one aspect of the present invention for determining a transition depth from a parameter of interest related to fluid pressure. A parameter of interest is obtained at a plurality of depths in the borehole (Box 701). The obtained data is analyzed to obtain a trend of the parameter at a plurality of depths over a large depth interval (global trend line) (Box 703). In various aspects, the large depth interval spans the depth at the surface (i.e., 0 ft.) to the current location of the drilling device or formation evaluation sensor. In Box 705, a subset of the data is then analyzed to obtain a trend for the parameter over a short depth interval (local trend line). A short depth interval is typically short compared to the global trend line and is determined from the deepest section drilled. A relation between the global trend line and the local trend line is determined in Box 707 to locate a pressure transition zone. In Box 709, a formation fluid pressure may be determined from the relationship between the global trend line and the local trend line. The depth at which the relationship between the global trend line and the local trend line meets a selected criterion can be obtained. In one aspect, a processor determining the relationship may generate an alert when such the relationship meets the selected criterion. In one aspect, the selected criterion may be a difference between slopes of the global trend line and the local trend line. Any of the one or more processors disclosed herein may perform the exemplary method of FIG. 7. In another aspect, a normal (hydrostatic) compaction zone may be determined and pore pressure calculated in the normal compaction zone. An alert may be generated if the pore pressure in the normal compaction zone becomes non-hydrostatic.

In addition, the method of the present disclosure may generate various alerts. In one embodiment, an alert may be generated when the number of obtained measurements over the second depth interval is smaller than a selected value. An alert may be generated when a length of the second depth interval is longer than a predefined maximum length or shorter than a predefined minimum length. Also, an alert may be generated when a depth corresponding to the obtained measurements is greater than a predefined maximum depth or less than a predefined minimum depth. An alert indicating that the global trend is substantially constant may be generated to indicate that the parameter is not usable for the exemplary method of the present disclosure.

The method may further determine a depth at which the determined relation between the determined global trend and the determined local trend meets a selected criterion. A plurality of local trends may be determined and compared to the global trend. The plurality of local trends may be determined over intervals having different lengths. A confidence level to the determined depth may be assigned based on an amount, number or fraction of the plurality of local trends that meet the selected criterion. In various aspects, the obtained measurements may be filtered prior to processing.

The exemplary system and methods disclosed herein includes a while-drilling or wireline technology to acquire data indicating the formation pore pressure distribution along the borehole, a technology to transmit the acquired data to a surface acquisition system (software and hardware), a surface acquisition system, and one or more processors capable of analyzing the relevant data. Data can be any data indicative of a formation pore pressure distribution with depth. The system further includes one or more memory devices storing a set of instructions that when accessed by a processor perform a method for analysis and generation of relevant information, parameters and alerts related to a formation pore pressure distribution.

Therefore, in one aspect of the present disclosure, a method of determining a pressure transition depth in a borehole is provided, the method including: obtaining measurements of a parameter indicative of formation fluid pressure at a plurality of borehole depths; determining a global trend of the parameter from the obtained measurement over a first depth interval; determining a local trend of parameter from the obtained measurements over a second depth interval; determining a relation between the estimated global trend and the estimated local trend; and determining the pressure transition depth from the determined relation between the determined global trend and the determined local trend. The second depth interval may be a subset of the first depth interval or an interval that is outside of the first depth interval. The second depth interval may be: (i) a particular depth interval; (ii) a depth corresponding to a selected number of obtained measurements; or (iii) a depth corresponding to measurements obtained over a selected time interval. The relation between the estimated global trend and the local trend is determined by at least one of: (i) comparing a slope of the determined global trend to a slope of the determined local trend; and (ii) comparing an intercept of the determined global trend to an intercept of the determined local trend. In various embodiments, the method generates an alert when at least one of: (i) the number of obtained measurements over the second depth interval is smaller than a selected value; (ii) a length of the second depth interval is longer than a predefined maximum length; (iii) the length of the second depth interval is shorter than a predefined minimum length; (iv) a depth corresponding to the obtained measurements is greater than a predefined maximum depth; (v) the depth corresponding to the obtained measurements is less than a predefined minimum depth; and (vi) the global trend is substantially constant. A depth is typically determined at which the relation between the determined global trend and the determined local trend meets a selected criterion. In an embodiment wherein the determined local trend further comprises a plurality of determined local trends, the method further includes assigning a confidence level to the depth based on an amount of the plurality of local trends that meet the selected criterion. In one embodiment, a pore pressure of the formation surrounding the borehole is determined and an alert is generated when the determined pore pressure is non-hydrostatic. The parameter may be one of: (i) resistivity; (ii) porosity; (iii) density; (iv) a seismic parameter; (v) an acoustic parameter; (vi) a nuclear magnetic resonance parameter; and (vii) a drilling exponent parameter. The parameter may be obtained during drilling of the borehole, during reaming of the borehole, during re-logging of the borehole, or using a wireline apparatus after drilling of the borehole, in various embodiments.

In another aspect of the present disclosure, an apparatus for estimating a pressure transition depth in a borehole is provided, the apparatus including: a sensor configured to measure a parameter indicative of formation fluid pressure at a plurality of borehole depths; and a processor configured to: determine a global trend of the parameter from the obtained measurements over a first depth interval, determine a local trend of the parameter from the obtained measurements over a second depth interval, determine a relation between the global trend of the parameter and the local trend of the parameter, and determine the pressure transition depth from the determined relation between the global trend of the parameter and the local trend of the parameter. The second depth interval may be a subset of the first depth interval, or an interval that is outside of the first depth interval, in various embodiments. The second depth interval may be a particular depth interval; a depth corresponding to a selected number of obtained measurements; or a depth corresponding to measurements obtained over a selected time interval. The processor is further configured to determine the relation between the global trend and the local trend by at least one of: (i) comparing a slope of the global trend to a slope of the local trend; and (ii) comparing an intercept of the global trend to an intercept of the local trend. The processor is further configured to generate an alert when at least one of: (i) the number of obtained measurements over the second depth interval is smaller than a selected value; (ii) a length of the second depth interval is longer than a predefined maximum length; (iii) the length of the second depth interval is shorter than a predefined minimum length; (iv) a depth corresponding to the obtained measurements is greater than a predefined maximum depth; (v) the depth corresponding to the obtained measurements is less than a predefined minimum depth; and (vi) the global trend is substantially constant. The processor is further configured to determine a transition zone from the determined transition depth. The processor is further configured to estimate a pore pressure over a selected depth and generate an alert when the estimated pore pressure is non-hydrostatic. The processor is configured to determine a depth at which the determined relation between the determined global trend and the determined local trend meets a selected criterion. Wherein the determined local trend further comprises a plurality of determined local trends, the processor is configured to assign a confidence level to the depth based on an amount of the plurality of local trends that meet the selected criterion. The parameter may be one of: (i) resistivity; (ii) porosity; (iii) density; (iv) a seismic parameter; (v) an acoustic parameter; (vi) a nuclear magnetic resonance parameter; and (vii) a drilling exponent parameter. The sensor may be conveyed in the borehole by one of: (i) a measurement-while drilling device, and (ii) a wireline apparatus.

In yet another aspect of the present disclosure, a method of drilling a borehole is provided, the method including: conveying a drilling assembly having a sensor configured to obtaining measurements of a parameter indicative of formation fluid pressure; obtaining measurements of the parameter at a plurality of borehole depths during drilling of the wellbore; determining a global trend of the parameter from the obtained measurement over a first depth interval; determining a local trend of parameter from the obtained measurements over a second depth interval; determining a relation between the estimated global trend and the estimated local trend; determining the pressure transition depth from the determined relation between the determined global trend and the determined local trend; and determining a pore pressure over a selected borehole depth and generating an alert if the determined pore pressure is non-hydrostatic. A drilling parameter may be altered in response to the determined pressure transition depth.

While the foregoing disclosure is directed to the preferred embodiments of the disclosure, various modifications will be apparent to those skilled in the art. It is intended that all variations within the scope and spirit of the appended claims be embraced by the foregoing disclosure.

The invention claimed is:

1. A method of determining a pressure transition depth in a borehole, comprising:

obtaining measurements of a parameter indicative of formation fluid pressure at a plurality of borehole depths extending from a starting depth to a selected depth;

determining a global trend line of the parameter using the obtained measurements over an entirety of a first depth interval extending from the starting depth to the selected depth;

determining a local trend line of the parameter using the obtained measurements within a second depth interval that includes the selected depth and is a subset of the first interval;

determining a deviation between the global trend line and the local trend line; and determining the pressure transition depth when the determined deviation between the global trend line and the local trend line meets a selected criterion.

2. The method of claim 1, wherein determining the deviation between the global trend line and the local trend line comprises at least one of: (i) comparing a slope of the global trend line to a slope of the local trend line; and (ii) comparing an intercept of the global trend line to an intercept of the local trend line.

3. The method of claim 1, wherein the second depth interval is selected as one of: (i) a particular depth interval; (ii) a depth corresponding to a selected number of obtained measurements; and (iii) a depth corresponding to measurements obtained over a selected time interval.

4. The method of claim 3 further comprising generating an alert when at least one of: (i) the number of obtained measurements within the second depth interval is smaller than a selected value; (ii) a length of the second depth interval is longer than a predefined maximum length; (iii) the length of the second depth interval is shorter than a predefined minimum length; (iv) a depth corresponding to the obtained measurements is greater than a predefined maximum depth; (v) the depth corresponding to the obtained measurements is less than a predefined minimum depth; and (vi) the global trend is substantially constant.

5. The method of claim 1, wherein the local trend line further comprises a plurality of local trend lines, further comprising assigning a confidence level to the pressure transition depth based on an amount of the plurality of local trend lines that meet the selected criterion.

6. The method of claim 1 further comprising determining a pore pressure of the formation surrounding the borehole and generating an alert when the determined pore pressure is non-hydrostatic.

7. The method of claim 1, wherein the parameter is one of: (i) resistivity; (ii) porosity; (iii) density; (iv) a seismic parameter; (v) an acoustic parameter; (vi) a nuclear magnetic resonance parameter; and (vii) a drilling exponent parameter.

8. The method of claim 1 further comprising obtaining the measurements of the parameter as one of: (i) during drilling of the borehole; (ii) during reaming of the borehole;(iii) during re-logging of the borehole; and (iv) using a wireline apparatus after drilling of the borehole.

9. An apparatus for estimating a pressure transition depth in a borehole, comprising:

a sensor configured to measure a parameter indicative of formation fluid pressure at a plurality of borehole depths extending from a starting depth to a selected depth; and a processor configured to:

determine a global trend line of the parameter using the obtained parameter measurements over an entirety of a first depth interval extending from the starting depth to the selected depth, determine a local trend line of the parameter using the obtained measurements within a second depth interval that includes the selected depth and is a subset of the first interval, determine a relation between the global trend line and the local trend line, and determine the pressure transition depth when the determined deviation between the global trend line and the local trend line meets a selected criterion.

10. The apparatus of claim 9, wherein the processor is further configured to determine the deviation between the global trend line and the local trend line by at least one of: (i) comparing a slope of the global trend line to a slope of the local trend line; and (ii) comparing an intercept of the global trend line to an intercept of the local trend line.

11. The apparatus of claim 9, wherein the second depth interval is selected as one of: (i) a particular depth interval; (ii) a depth corresponding to a selected number of obtained measurements; and (iii) a depth corresponding to measurements obtained over a selected time interval.

12. The apparatus of claim 9 wherein the processor is further configured to generate an alert when at least one of: (i) the number of obtained measurements within the second depth interval is smaller than a selected value; (ii) a length of the second depth interval is longer than a predefined maximum length; (iii) the length of the second depth interval is shorter than a predefined minimum length; (iv) a depth corresponding to the obtained measurements is greater than a predefined maximum depth; (v) the depth corresponding to the obtained measurements is less than a predefined minimum depth; and (vi) the global trend line is substantially constant.

13. The apparatus of claim 9, wherein the processor is further configured to determine a transition zone from the determined transition depth.

14. The apparatus of claim 9, wherein the processor is further configured to estimate a pore pressure over a selected depth and generate an alert when the estimated pore pressure is non-hydrostatic.

15. The apparatus of claim 9, wherein the local trend line further comprises a plurality of local trend lines and the processor is further configured to assign a confidence level to the pressure transition depth based on an amount of the plurality of local trend lines that meet the selected criterion.

16. The apparatus of claim 9, wherein the parameter is selected from a group consisting of: (i) resistivity; (ii) porosity; (iii) density; (iv) a seismic parameter; (v) an acoustic parameter; (vi) a nuclear magnetic resonance parameter; and (vii) a drilling exponent parameter.

17. The apparatus of claim 9, wherein the sensor is conveyed in the borehole by one of: (i) a measurement-while drilling device, and (ii) a wireline apparatus.

18. A method of drilling a borehole, comprising:

conveying a drilling assembly having a sensor configured to obtain measurements of a parameter indicative of formation fluid pressure;

obtaining measurements of the parameter at a plurality of borehole depths over a first depth interval extending from a starting depth to a selected depth during drilling of the wellbore;

determining a global trend line of the parameter using the obtained measurement over an entirety of a first depth interval extending from the starting depth to the selected depth;

determining a local trend line of parameter using the obtained measurements within a second depth interval that includes the selected depth and is a subset of the first interval;

determining a deviation between the global trend line and the local trend line;

determining the pressure transition depth when the determined deviation between the global trend line and the local trend line meets a selected criterion; and determining a pore pressure over a selected borehole depth and generating an alert when the determined pore pressure is non-hydrostatic.

19. The method of claim 18 further comprising altering a drilling parameter in response to the determined pressure transition depth.

* * * * *